US011920264B2

(12) United States Patent
Dumoulin et al.

(10) Patent No.: US 11,920,264 B2
(45) Date of Patent: Mar. 5, 2024

(54) YARN CLEARER AND CUTTING DEVICE FOR A YARN CLEARER

(71) Applicant: Saurer Intelligent Technology AG, Arbon (CH)

(72) Inventors: Charles Leopold Elisabeth Dumoulin, Balgach (CH); Kalidass Santhoshkumar, Coimbatore (IN); Ilir Adili, Widnau (CH)

(73) Assignee: Saurer Intelligent Technology AG, Arbon (CH)

( * ) Notice: Subject to any disclaimer, the term of this patent is extended or adjusted under 35 U.S.C. 154(b) by 0 days.

(21) Appl. No.: 17/981,157

(22) Filed: Nov. 4, 2022

(65) Prior Publication Data

US 2023/0134474 A1 May 4, 2023

(30) Foreign Application Priority Data

Nov. 4, 2021 (EP) ..... 21206556

(51) Int. Cl.
*D02J 3/02* (2006.01)
*D06H 7/02* (2006.01)

(52) U.S. Cl.
CPC . *D02J 3/02* (2013.01); *D06H 7/02* (2013.01)

(58) Field of Classification Search
CPC ..... D02J 3/02; D02J 7/00; B26D 1/04; B26D 1/045; B26D 1/08; B26D 1/085;
(Continued)

(56) References Cited

U.S. PATENT DOCUMENTS 2,624,933 A * 1/1953 Quick ..... B65H 63/061 28/235
2,654,938 A * 10/1953 Kennedy ..... B65H 63/061 28/235

(Continued)

FOREIGN PATENT DOCUMENTS

DE 2405458 A1 2/1975
EP 0253934 A1 1/1988

*Primary Examiner* — Amy Vanatta
(74) *Attorney, Agent, or Firm* — Fox Rothschild LLP

(57) ABSTRACT

The present invention relates to a yarn clearer for a workstation of a textile machine with a cutting device for clearing out defects from a yarn as well as a cutting device for a yarn clearer which can be arranged at a workstation of a textile machine, with a housing body having a housing basic body, a housing cover which covers the housing basic body at least in sections and together with the housing basic body delimits a housing interior and a first housing opening and a cutting device with a cutting medium carrier having a cutting knife, a cutting medium drive arranged in the housing interior for adjusting the cutting medium carrier between a cutting position remote from the housing and a rest position close to the housing and a drive element connecting the cutting medium drive and the cutting medium carrier and adjustably arranged in the first housing opening. In order to provide a yarn clearer with a cutting device as well as a cutting device which ensure reliable separation of the yarn when required, there is provision for the housing body to have a bearing section for adjustably receiving the cutting medium carrier and a second housing opening adjacent to the bearing section with an opening edge extending perpendicularly to the adjustment direction of the cutting medium carrier and abutting the cutting medium carrier.

8 Claims, 2 Drawing Sheets

(58) Field of Classification Search
CPC . B26D 5/08; B26D 5/086; B26D 1/06; B26D 1/065; B26D 7/0006; B65H 54/71; B65H 2701/31; D06H 7/02; D04B 35/00
USPC ..... 28/226, 222, 173, 235
See application file for complete search history.

(56) References Cited

U.S. PATENT DOCUMENTS

| | | | | | |
|---|---|---|---|---|---|
| 2,860,704 | A * | 11/1958 | Mirick | B26D 5/38 | 83/366 |
| 3,175,290 | A * | 3/1965 | Bunting, Jr. | B65H 54/88 | 83/402 |
| 3,322,013 | A * | 5/1967 | Ernst | B65H 54/71 | 83/575 |
| 3,624,720 | A * | 11/1971 | Laky | B23D 29/002 | 83/639.1 |
| 3,854,356 | A | 12/1974 | Okreglak | | |
| 3,894,459 | A * | 7/1975 | Deppe | D03D 47/00 | 83/636 |
| 4,051,756 | A * | 10/1977 | Bognar | B65H 54/71 | 83/567 |
| 5,150,640 | A * | 9/1992 | Schnitzer | B65H 54/71 | 83/639.1 |
| 5,211,709 | A * | 5/1993 | Hussey | B65H 63/036 | 242/487.7 |
| 5,839,342 | A * | 11/1998 | Cope | B65H 54/71 | 83/639.1 |
| 2013/0192436 | A1* | 8/2013 | Barea | B65H 54/71 | 83/79 |

* cited by examiner

YARN CLEARER AND CUTTING DEVICE FOR A YARN CLEARER

CROSS REFERENCE TO RELATED APPLICATIONS

This application claims, under 35 U.S.C. § 119(a), the benefit of European Patent Application No. EP21206556.9, filed on Nov. 4, 2021, the disclosure of which is incorporated herein by reference in its entirety.

The present invention relates to a cutting device for a yarn clearer which can be arranged at a workstation of a textile machine, with

- a housing body having
  - a housing basic body,
  - a housing cover covering the housing basic body at least in sections and delimiting a housing interior together with the housing basic body, and
  - a first housing opening and
- a cutting device with
  - a cutting medium carrier comprising a cutting knife,
  - a cutting medium drive arranged in the housing interior for adjusting the cutting medium carrier between a cutting position remote from the housing and a rest position close to the housing, and
  - a drive element connecting the cutting medium drive and the cutting medium carrier, and adjustably arranged in the first housing opening.

In the manufacture of yarns, the aim is usually to achieve the highest possible uniformity of the finished yarn within narrow tolerances, as well as a yarn without visible defects, such as intolerable thick or thin places. To achieve this, what are called the yarn clearers are used at the individual workstations of a textile machine, which, for example, continuously monitor the diameter of the yarn with a suitable measuring head. If an intolerable defect is detected due to exceeding or falling below the limit values designated as clearing limits, the defect is cut out of the yarn by means of the cutting device of the yarn clearer arranged in the housing body, the yarn ends are reconnected and the production process is continued.

Cutting devices of prior art for yarn clearers have, for example, an electromagnetically acting cutting medium drive, in which case a cutting medium carrier, on which a cutting knife is arranged, is adjusted by means of the cutting medium drive in the manner of a chisel between a rest position and a cutting position, with a yarn arranged between the cutting medium carrier and an anvil being cut in the cutting position.

In cutting devices of prior art, the cutting device is arranged inside a housing body and connected via a drive element, which extends through a first housing opening, to the cutting medium carrier arranged outside the housing interior, so that the cutting medium carrier can be adjustably brought into engagement with the yarn via the drive element by means of the cutting medium drive.

The cutting device is preferably arranged on the housing body in such a way that, in the installation position of the yarn clearer, the cutting device is preferably arranged at the front end of the housing body—in relation to the yarn running direction—so that it is ensured that, due to the rotational inertia of a bobbin receiving the yarn, a thread guide area of the yarn clearer is free of thread after the cut. However, arranging the cutting device in the entrance area of the housing body—in relation to the yarn running direction—has the disadvantage that this area is loaded with a higher concentration of loose fibres due to the system.

Despite enclosure of the cutting device in the housing body, this fibre load can cause fibres to build up in the area of the first housing opening and from there to enter the housing interior, where they lead to increased friction in the area of the cutting device and thus to a low cutting force and, as a result, to faulty cutting procedures.

Based on this, the problem addressed by the present invention is one of providing a yarn clearer with a cutting device as well as a cutting device which ensure reliable separation of the yarn when required.

The present invention solves the problem by means of a cutting device having the features of claim 1 and by means of a yarn clearer having the features of claim 10. Advantageous further developments of the cutting device are stated in the subordinate claims 2 to 9.

A characteristic feature of the cutting device according to the present invention is that the housing body has

- a bearing section for adjustably receiving the cutting medium carrier and
- a second housing opening adjacent to the bearing section with an opening edge extending perpendicular to the adjustment direction of the cutting medium carrier and abutting the cutting medium carrier.

The housing body of the cutting device according to the present invention has a housing basic body and a housing cover at least partially covering the housing basic body. The housing cover and the housing basic body jointly delimit a housing interior within which a cutting medium drive of a cutting device is arranged. For adjusting a cutting medium carrier arranged outside the housing interior, which is formed with a cutting knife having a cutting edge, the housing body has a first housing opening, which is connected to the housing interior and through which a drive element extends, which drive element connects the cutting medium drive to the cutting medium carrier, so that the cutting medium carrier can be adjusted between a rest position and a cutting position by means of the cutting medium drive, the drive element being arranged adjustably in the first housing opening for this purpose.

According to the present invention, there is further provision for the housing body to have a bearing section in the region in front of the first housing opening, i.e. outside the housing interior, for adjustably receiving the cutting medium carrier, and the bearing section has a second housing opening opposite the first housing opening in the adjustment direction of the cutting medium carrier between the rest position and the cutting position. The second housing opening is designed in such a way that its opening edge, which runs coaxially to the adjustment direction of the cutting medium carrier, rests against the latter, but at the same time ensures an adjustment movement of the cutting medium carrier relative to the housing body between the cutting position and the rest position.

The embodiment of the cutting device according to the present invention with a housing body which also encloses the cutting medium carrier in the region of the bearing section, the second housing opening enabling the cutting medium carrier to be displaced from a rest position close to the housing into a cutting position remote from the housing, in which a cutting knife on the cutting medium carrier interacts with a stop and in the process cuts through a yarn located in between, reliably ensures that no loose fibres enter the housing interior and lead to increase in friction there, which could result in unreliable cutting performance.

According to an advantageous further embodiment of the present invention, there is provision for the housing body to be designed in the region of the second housing opening for flush arrangement of an end face of the cutting medium carrier in the rest position. According to this embodiment of the present invention, the preferably level end face of the cutting medium carrier, on which the cutting knife is arranged, extends in the rest position in a plane with the surface of the housing body surrounding the second housing opening. To carry out a cutting operation, the cutting medium carrier is displaced relative to the housing body from the flush arrangement into the cutting position, in which the end face projects at least in sections from the housing body or, in an alternatively preferred embodiment, is arranged at a distance there from. The flush arrangement of the end face in the rest position ensures in a particularly reliable manner that in the rest position there are no unwanted deposits of free fibres in the area of the cutting medium carrier on the housing body, which could be transported in the direction of the housing interior in the event of an adjustment of the cutting medium carrier, in particular during a return movement from the cutting position to the rest position. The flush arrangement in the rest position can particularly reliably prevent a deposit of free fibres in the area of the second housing opening, since this avoids edges that favour an accumulation of free fibres.

According to a further embodiment of the present invention, there is provision for the first housing opening to abut the drive element with an opening edge extending perpendicular to the adjustment direction of the drive element. This embodiment of the present invention, in which the opening edge of the first housing opening, in addition to a guiding function of the drive element in the housing body, also assumes a sealing effect, ensures in a supplementary manner that any free fibres that may have penetrated into the bearing section via the second housing opening are not transported further into the housing interior, in which the cutting medium drive that drives the cutting medium carrier via the drive element is arranged. Contamination of the housing interior is prevented in a supplementary manner by the advantageously provided embodiment of the first housing opening.

The embodiment of the bearing section in the area between the first and second housing openings, in which the cutting medium carrier is arranged so that it can be adjusted between the rest position and the cutting position, is basically freely selectable. According to a particularly advantageous embodiment of the present invention, there is provision for the bearing section delimited by the housing cover and housing basic body to have at least one wall section arranged at a distance from the cutting medium carrier to form an expansion range.

According to this embodiment of the present invention, there is provision for the bearing section not to rest circumferentially against the cutting medium carrier, but for at least one of the wall sections provided by the housing basic body and housing cover—viewed transversely to the adjustment direction of the cutting medium carrier between the rest position and the cutting position—to be arranged at a distance from the cutting medium carrier. The expansion range thus represents a free area between the first and second housing opening, which has a larger free cross-section compared to the free area of the second housing opening, so that under certain circumstances free fibres penetrating through the first housing opening into the bearing section do not reach the second housing opening due to the expanding housing section and the resulting pressure difference, despite a suction effect arising in the area of the second housing opening during a return movement of the cutting medium carrier from the cutting position to the rest position. Due to its larger cross-section, the expansion range reduces any vacuum that may prevail.

According to a further embodiment of the present invention, there is provision for the cutting medium carrier to have a protrusion projecting into the expansion region and adjustable therein between the rest position and the cutting position. According to this embodiment of the present invention, there is provision for the cutting medium carrier to have a protrusion, for example in the form of a bar, which extends over the width of the expansion region—viewed transversely to the adjustment direction of the cutting medium carrier—into the latter up to the wall section arranged at a distance from the cutting medium carrier, so that, during a displacement of the cutting medium carrier from the rest position into the cutting position in the course of the previous displacement from the cutting position into the rest position, the protrusion possibly conveys free fibres which have penetrated into the expansion region of the bearing section out of the bearing section via the second housing opening, with the result that an impairment of the cutting device by deposited fibres can be prevented in a particularly reliable manner.

According to a further embodiment of the present invention, there is provision for the housing body to have a ventilation opening ventilating the housing interior, which is preferably arranged on a side of the housing body that is different from the first housing opening, particularly preferably on an underside of the housing body or on a side of the housing body opposite the first housing opening. According to this embodiment of the present invention, the housing body basically has a ventilation opening at any point, but preferably at a side of the housing body defined as above—with respect to the installation position of the cutting device—i.e. at a side of the housing body oriented opposite to the yarn running direction, which connects the surroundings of the housing body with the housing interior.

In the event of an adjustment of the cutting medium carrier from the rest position to the cutting position, in which the drive element is displaced out of the housing interior in the direction of the first and second housing openings and thereby generates a vacuum within the housing interior, ambient air can flow into the housing interior via the ventilation opening, so that the formation of a vacuum in the housing interior, which would promote the penetration of fibres in the region of the first and second housing opening into the bearing section and/or the housing interior, is prevented. In addition, it is possible to actively ventilate the housing interior via the ventilation opening so that a positive pressure can be generated in the housing interior, which additionally counteracts the penetration of free fibres.

According to a further embodiment of the present invention, there is provision for the inner walls of the bearing section and/or the outer surfaces of the cutting medium carrier and/or the outer surfaces of the drive element to have a polished surface. A polished surface is defined as an average roughness Ra of the surfaces in the range from 0.01 to 0.2. A corresponding quality of surface finish additionally prevents free fibres from attaching to the individual surfaces and entering the bearing section and/or housing interior in the event of an adjustment of the cutting medium carrier. The polished surfaces favour the effect of the free fibres sliding off.

The design of the housing basic body and the housing cover to form the housing body is basically freely selectable. For example, the housing basic body and housing cover can each be designed as half-shell-shaped bodies, which together delimit the housing interior and the bearing section. According to an advantageous further development of the present invention, however, there is provision for the housing basic body to have a flat housing basic body inner wall and the housing cover to have a housing cover edge standing circumferentially on the housing basic body inner wall and a housing cover basic body adjoining the housing cover edge.

According to this embodiment of the present invention, the housing basic body provides a substantially level housing basic body inner wall on which the half-shell-shaped housing cover with a circumferential housing cover edge rests so that the housing cover basic body opposite the housing basic body inner wall is spaced apart from the level surface of the housing basic body. This embodiment of the present invention provides a particularly simple way of manufacturing the housing body, in which the housing basic body inner wall can be provided by further housing bodies of the yarn clearer. In addition, this embodiment of the present invention offers the possibility of providing the bearing section provided in accordance with the present invention, as well as other advantageous embodiments of the housing body, solely by means of a corresponding embodiment of the housing cover. Thus, according to a particularly advantageous further development of the present invention, the housing cover for forming the bearing section has housing cover bars projecting from the housing cover basic body in the direction of the housing basic body and resting on the flat housing basic body inner wall of the housing basic body.

The present invention further solves the problem by a yarn clearer for a workstation of a textile machine with a cutting device for clearing out defects from a yarn, comprising a cutting device developed further according to the present invention or described above.

A yarn clearer according to the present invention is characterised by its high reliability in carrying out the cutting processes, in which case malfunctions due to impurities of the yarn clearer in the area of the cutting device can be avoided particularly effectively.

An embodiment example of the present invention is explained below with reference to the drawings. In the drawings.

Figure 1:
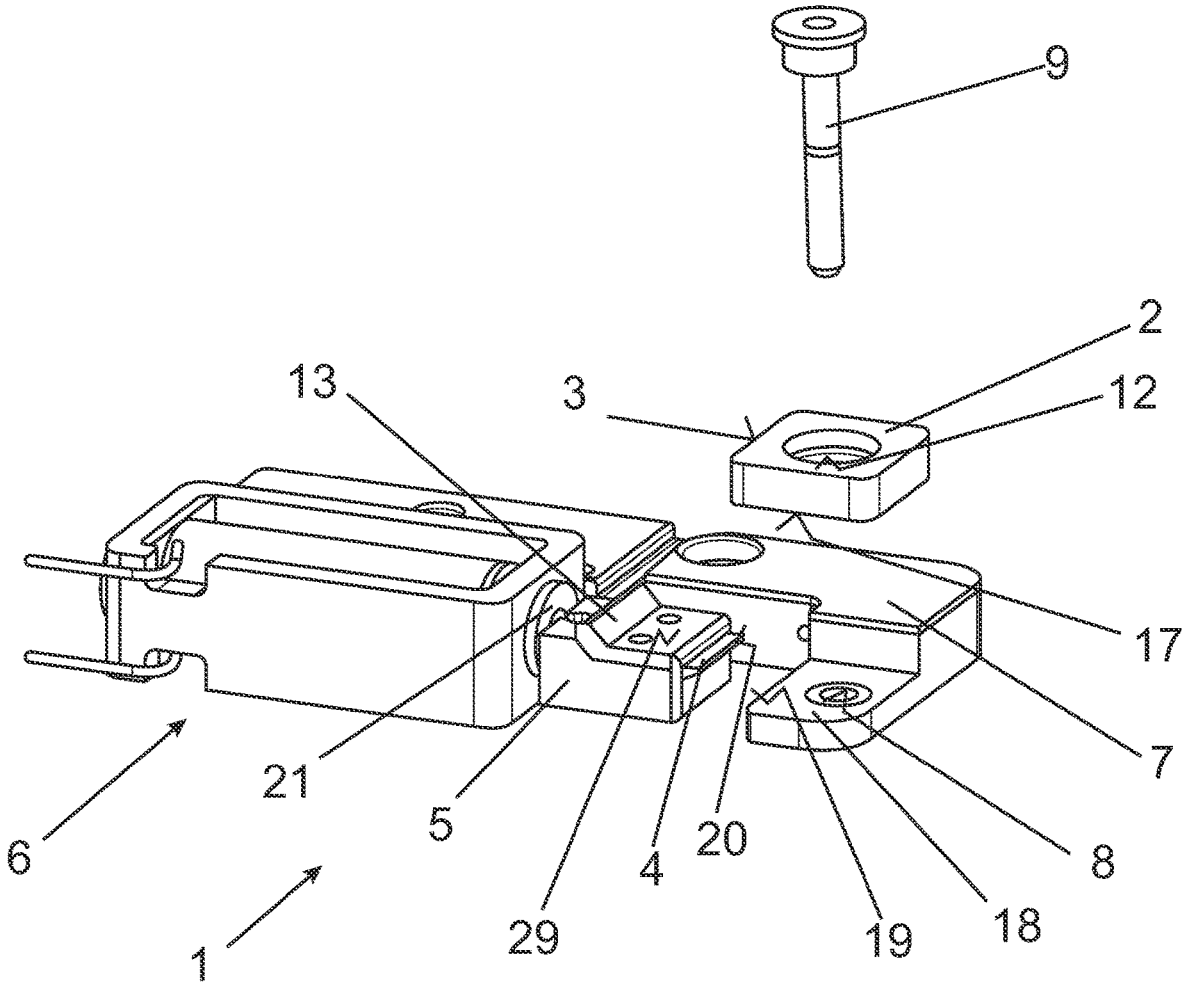
FIG. 1 shows an exploded version of a perspective view of an embodiment of a cutting device that can be arranged in a housing body.

FIG. 1 shows a perspective view of an embodiment of a cutting device 1 with a cutting medium drive 6, a drive element 21 and a cutting medium carrier 5, on which a cutting knife 4 having a cutting edge 20 is arranged.

By means of the cutting medium drive 6, the cutting medium carrier 5 can be adjusted from the rest position shown in FIG. 1 into a cutting position not shown here, in which the cutting edge 20 engages with a stop surface 3 of an anvil 2 arranged on an anvil carrier 7, and cuts a yarn (not shown here) located in between.

The anvil 2 rests with an underside 17 on an upper side 19 of a fastening section 18 of the anvil carrier 7 and is screwed to this via a fastening screw 9, which extends through a through-bore 12 in the anvil 2 into a threaded hole 8 on the fastening section 18. According to an embodiment not shown, the fastening screw 9 can be screwed into a housing base not shown.

Figure 2:
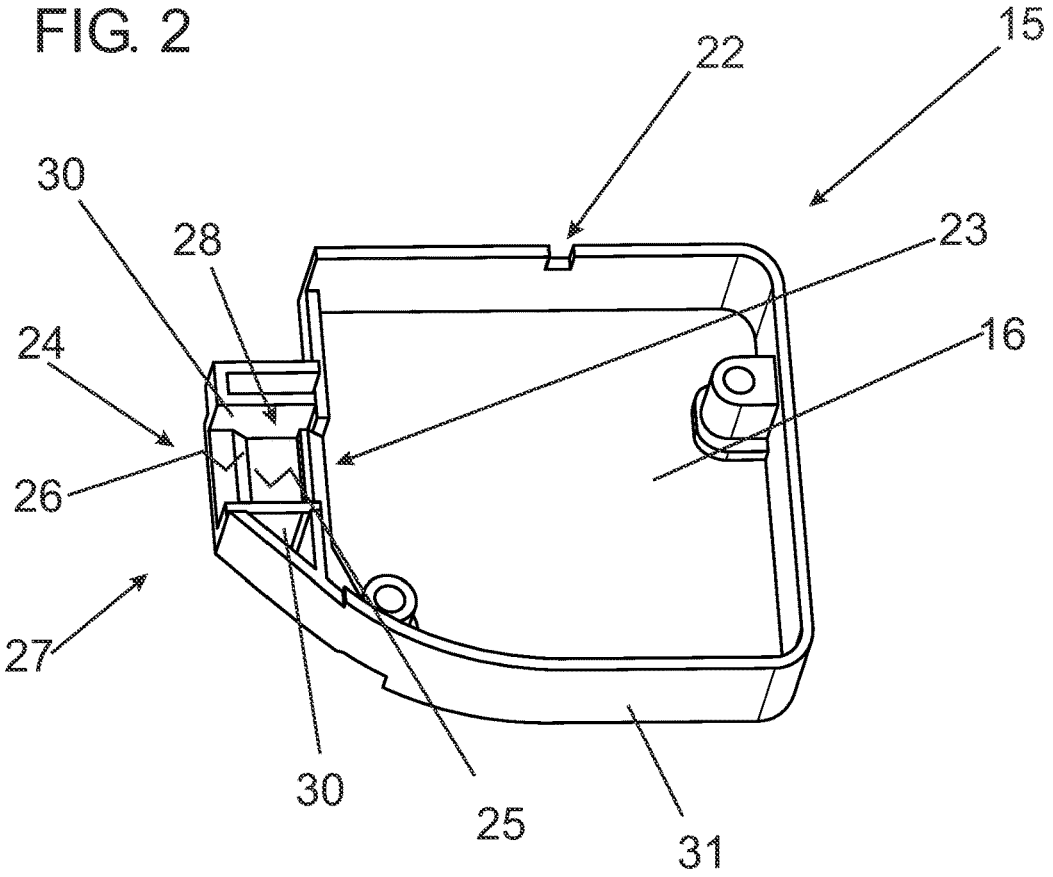
FIG. 2 shows a perspective view of a housing cover that can be arranged on a flat housing body for receiving a cutting medium drive and a cutting medium carrier of the cutting device of FIG. 1.
Figure 3:
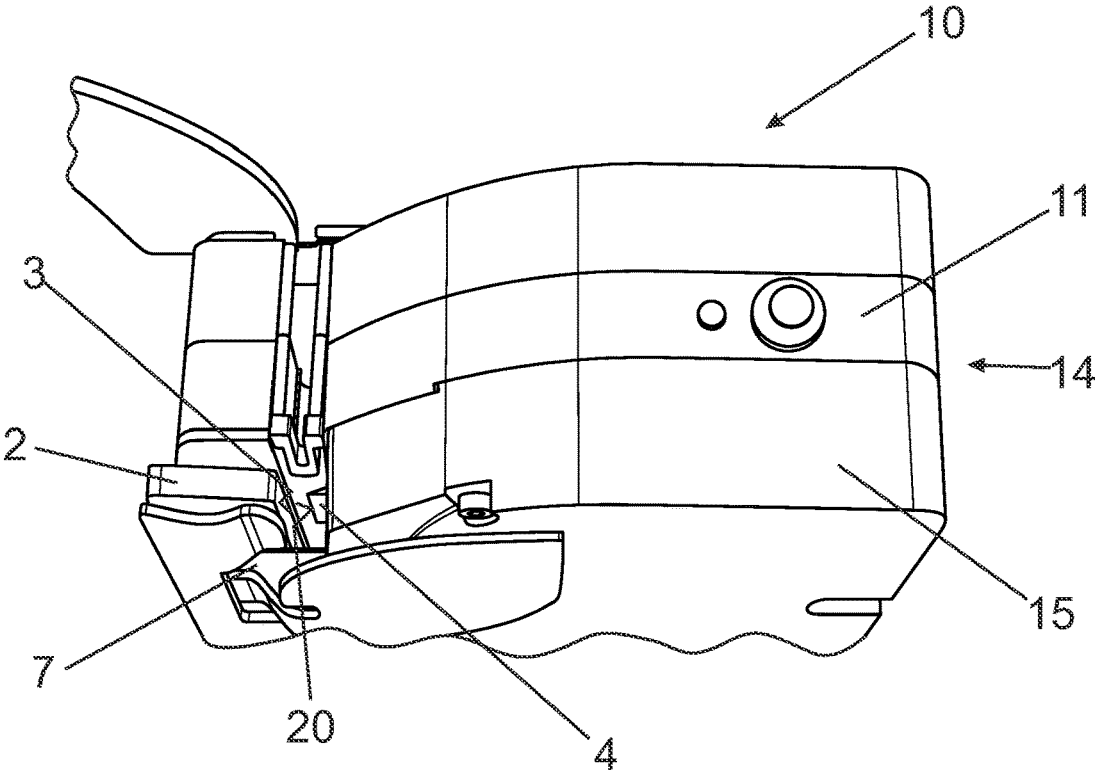
FIG. 3 shows a perspective view of a yarn clearer.

FIG. 3 shows a perspective view of a yarn clearer 10 with a housing body 14 formed from a housing cover 15 and a housing basic body 11. The housing basic body 11, which is part of the yarn clearer 10, provides a flat housing basic body inner wall to form the housing body 14, which is covered by the housing cover 15 and thus delimits a housing inner space 16 from the surroundings of the yarn clearer 10. As shown in FIG. 2, the housing cover 15 rests on the inner wall of the housing basic body with a housing cover edge 31 and housing bars 30. To form the cutting device consisting of the cutting device 1 and the housing body 14, the cutting device 1 is arranged in sections within the housing body 14, with the cutting knife 4 on the cutting medium carrier 5 projecting from the housing body 14 in the direction of the stop surface 3 of the anvil 2 in the rest position shown. During operation of the yarn clearer, a yarn (not shown here) runs in the area between the stop surface 3 of the anvil 2 and the cutting edge 20 of the cutting knife 4. If a yarn cut is to be made, the cutting knife 4 is moved from the rest position shown to the cutting position in which the cutting edge 20 rests against the stop surface 3 of the anvil 2 and cuts through the yarn in between.

The cutting medium drive 6 of the cutting device 1 is arranged inside the housing interior 16 of the housing cover 15. The cutting medium drive 6 is connected via the drive element 21 to the cutting medium carrier 5, which is adjustable between the rest position and the cutting position within a bearing section 27 of the housing cover. In this case, the drive element 21 projects through a first housing opening 23 of the housing cover 15, so that when the cutting medium drive 6 is activated, the cutting medium carrier 5 is displaced within the bearing section 27 between the rest position and the cutting position, the cutting medium carrier 5 being displaced within a second housing opening 24 to the cutting position, in which the cutting edge 20 of the cutting knife 4 rests against the stop surface 3 of the anvil 2 at a distance from the outer wall of the housing cover 15.

The second housing opening 24 and first housing opening 23 of the housing cover 15, which are arranged one behind the other in the adjustment direction, are designed in such a way that they rest against the drive element 21 and the cutting medium carrier 5 with a circumferential opening edge 26, so that any free fibres present in the area in front of the second housing opening 24 do not enter the bearing section 27.

The bearing section 27 further has a wall section 25 spaced apart from an upper side 29 of the cutting medium carrier 5, thereby forming an expansion region 28 in which any free fibres that may penetrate are collected due to the existing pressure difference and are not moved on towards the first housing opening 23.

The cutting medium carrier 5 has a bar-like protrusion 13 which extends over the width of the expansion range 28—viewed transversely to the adjustment direction—and projects into the latter, so that any free fibres arranged in the expansion range 28 can be moved or pushed out of the second housing opening 24 by the protrusion 13 when the cutting medium carrier 5 is adjusted from the rest position into the cutting position.

On a housing underside, the housing cover 15 has a ventilation opening 22 through which there is a fluidity connection between the housing interior 16 and the surroundings, so that when the drive element 21 is moved from the rest position to the cutting position, air from the surroundings of the housing cover 15 can flow into the housing interior 16 and counteract the formation of vacuum.

The anvil carrier 7 protrudes from the housing body 14 and with the anvil 2 it forms a stop surface 3 opposite the cutting edge 20 of the cutting knife 4, with the yarn being passed between the housing cover 15 and the anvil 2 during operation of the yarn clearer 10.

| List of reference signs | |
|---|---|
| 1 | Cutting device |
| 2 | Anvil |
| 3 | Stop surface |
| 4 | Cutting knife |
| 5 | Cutting medium carrier |
| 6 | Cutting medium drive |
| 7 | Anvil carrier |
| 8 | Threaded hole |
| 9 | Fastening screw |
| 10 | Yarn clearer |
| 11 | Housing basic body |
| 12 | Through-bore |
| 13 | Protrusion |
| 14 | Housing body |
| 15 | Housing cover |
| 16 | Housing interior |
| 17 | Underside |
| 18 | Fastening section |
| 19 | Upper side |
| 20 | Cutting edge |
| 21 | Drive element |
| 22 | Ventilation opening |
| 23 | First housing opening |
| 24 | Second housing opening |
| 25 | Wall section |
| 26 | Opening edge |
| 27 | Bearing section |
| 28 | Expansion range |
| 29 | Upper side |
| 30 | Housing bar |
| 31 | Housing cover edge |

The invention claimed is:

1. A cutting device for a yarn clearer (10), configured to be arranged at a workstation of a textile machine, comprising:

a housing body (14), comprising:

a housing basic body (11), comprising:

a flat housing basic body inner wall; and a housing cover (15), comprising:

a housing cover edge (31) standing circumferentially on the housing basic body inner wall;

a housing cover basic body adjoining the housing cover edge (31); and housing cover bars (30) projecting from the housing cover basic body in a direction of the housing basic body (11) and resting on the housing basic body inner wall, wherein the housing cover (15) is configured to:

cover the housing basic body (11), at least in sections; and delimit a housing interior (16), together with the housing basic body (11); and a first housing opening (23) connected to the housing interior (16); and a cutting device (1), comprising:

a cutting medium carrier (5) comprising a cutting knife (4);

a cutting medium drive (6), arranged in the housing interior (16), configured to adjust the cutting medium carrier (5) between a cutting position remote from the housing and a rest position close to the housing; and a drive element (21), configured to connect the cutting medium drive (6) and the cutting medium carrier (5), wherein the drive element (21) is adjustably arranged in the first housing opening (23), wherein:

the housing body (14) comprises:

a bearing section (27) configured to adjustably receive the cutting medium carrier (5); and a second housing opening (24), adjacent to the bearing section (27), comprising an opening edge (26), extending perpendicular to an adjustment direction of the cutting medium carrier (5), and abutting the cutting medium carrier (5), and the housing cover (15) is configured for forming the bearing section (27).

2. The cutting device according to claim 1, wherein, in a region of the second housing opening (24), the housing body (14) is configured for flush arrangement of an end face of the cutting medium carrier (5) in the rest position.

3. The cutting device according to claim 1, wherein the first housing opening (23) abuts the drive element (21) with an opening edge (26) extending perpendicular to an adjustment direction of the drive element (21).

4. The cutting device according to claim 1, wherein the bearing section (27):

is configured for forming an expansion range (28); and comprises at least one wall section (25) arranged at a distance from the cutting medium carrier (5).

5. The cutting device according to claim 4, wherein the cutting medium carrier (5) comprises a protrusion (13) projecting into the expansion range (28) and adjustable therein between the rest position and the cutting position.

6. The cutting device according to claim 1, wherein the housing body (14) has a ventilation opening (22) ventilating the housing interior (16), which is arranged on an underside of the housing body (14).

7. The cutting device according to claim 1, wherein one or more of the following surfaces comprise a polished surface:

inner walls of the bearing section (27);

outer surfaces of the cutting medium carrier (5); and outer surfaces of the drive element (21).

8. A yarn clearer for a workstation of a textile machine, comprising:

a cutting device configured for clearing out defects from a yarn, wherein the cutting device is designed in accordance with claim 1.

* * * * *